US006429582B1

(12) United States Patent
Watkins et al.

(10) Patent No.: US 6,429,582 B1
(45) **Date of Patent: *Aug. 6, 2002**

(54) DISPLAY DEVICE WITH GRILLE HAVING GETTER MATERIAL

(75) Inventors: Charles M. Watkins, Meridian; David A. Cathey, Boise, both of ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/535,704

(22) Filed: Mar. 27, 2000

Related U.S. Application Data

(62) Division of application No. 09/237,394, filed on Jan. 26, 1999, now Pat. No. 6,054,808, which is a division of application No. 08/820,815, filed on Mar. 19, 1997, now Pat. No. 5,931,713.

(51) Int. Cl.[7] ..... H01J 1/72

(52) U.S. Cl. ..... 313/495; 313/496; 313/553; 313/559

(58) Field of Search ..... 313/495, 496, 313/553, 559, 461, 466, 467, 473, 474, 481

(56) References Cited

U.S. PATENT DOCUMENTS 3,665,241 A 5/1972 Spindt et al. ..... 313/351
3,755,704 A * 8/1973 Spindt et al. ..... 313/309
3,812,559 A 5/1974 Spindt et al. ..... 29/25.18
3,870,917 A 3/1975 Cuny ..... 313/105

(List continued on next page.)

FOREIGN PATENT DOCUMENTS

JP 2-295032 5/1990

OTHER PUBLICATIONS

Borghi, M., Dr., *ST 121 and ST 122 Porous Coating Getters*, New Edition 19 Nov. 92, Original Jul. 87, pp. 3–13.

Giorgi, T. A., *Proc. 6th Internl, Vacuum, Congr. 1974, Japan J. Appl. Phys, Suppl. 2, Pt. 1974*, "Getters and Gettering", pp. 53–60.

Giorgi E. and Ferrario, B., *IEEE, Transactions on Electron Devices*, vol. 36, No. 11, Nov. 1989, High–Porosity Thick–Film Getters, pp. 2744–2747.

Giorgi, T. A., Ferrario, B., and Storey, B., *J.Vac.Sci.Technol*, A3 (2) Mar./Apr. 1985, "An updated review of getters and gettering", pp. 417–423.

*Primary Examiner*—Ashok Patel
(74) *Attorney, Agent, or Firm*—Hale and Dorr LLP

(57) ABSTRACT

A field emission display has an anode with a grille made at least in part of a getter material. The grille defines regions that are coated with phosphor to form pixels, and also getters free molecules within a sealed display. The getter material can alternatively be formed directly on at least a part of the grille, or over the grille on an intermediate layer.

15 Claims, 3 Drawing Sheets

U.S. PATENT DOCUMENTS

| | | | | |
|---|---|---|---|---|
| 3,926,832 | A | 12/1975 | Barosi | 252/181.6 |
| 4,297,082 | A | 10/1981 | Wurtz et al. | 417/51 |
| 4,312,669 | A | 1/1982 | Boffito et al. | 75/177 |
| 4,743,797 | A | 5/1988 | Emberson et al. | 313/422 |
| 4,789,309 | A | 12/1988 | Giorgi | 417/51 |
| 4,839,085 | A | 6/1989 | Sandrock et al. | 252/181.6 |
| 4,874,339 | A | 10/1989 | Bratz | 445/28 |
| 4,891,110 | A | 1/1990 | Libman et al. | 204/181.1 |
| 4,940,300 | A | 7/1990 | Giorgi | 313/558 |
| 4,977,035 | A | 12/1990 | Travis et al. | 428/550 |
| 5,057,047 | A | 10/1991 | Greene et al. | 445/24 |
| 5,060,051 | A | 10/1991 | Usuda | 257/765 |
| 5,064,393 | A | 11/1991 | Spindt | 445/50 |
| 5,186,670 | A | 2/1993 | Doan et al. | 445/24 |
| 5,207,607 | A | 5/1993 | Nagano et al. | 445/25 |
| 5,210,472 | A | 5/1993 | Casper et al. | 315/349 |
| 5,223,766 | A | 6/1993 | Nakayama et al. | 313/309 X |
| 5,229,331 | A | 7/1993 | Doan et al. | 437/228 |
| 5,283,500 | A | 2/1994 | Kochanski | 313/309 X |
| 5,453,659 | A | 9/1995 | Wallace et al. | 313/495 |
| 5,469,014 | A | 11/1995 | Itoh et al. | 313/309 X |
| 5,520,563 | A | 5/1996 | Wallace et al. | 445/24 |
| 5,614,785 | A | 3/1997 | Wallace et al. | 313/495 |
| 5,688,708 | A | 11/1997 | Kato et al. | 437/51 |
| 5,689,151 | A | 11/1997 | Wallace et al. | 313/495 |
| 5,693,438 | A | 12/1997 | Liu et al. | 430/28 |
| 5,866,978 | A | 2/1999 | Jones et al. | 313/495 |
| 5,869,928 | A | 2/1999 | Liu et al. | 313/495 |

* cited by examiner

DISPLAY DEVICE WITH GRILLE HAVING GETTER MATERIAL

CROSS-REFERENCE TO RELATED APPLICATIONS

This application is a divisional of Ser. No. 09/237,394, filed Jan. 26, 1999 now U.S. Pat. No. 6,054,808 pending; which is a divisional of Ser. No. 08/820,815, filed Mar. 19, 1998 now U.S. Pat. No. 5,931,713.

BACKGROUND OF THE INVENTION

This invention relates to display devices, and more particularly to getters used in field emission displays (FEDs).

In a typical FED, a cathode has a plurality of conical emitters that addressably and controllably emit electrons, and an anode has a transparent dielectric layer, a transparent conductive layer over the dielectric layer, a grille formed over the conductive layer to define pixel regions, and a phosphor coating applied to the conductive layer in the defined pixel regions. When activated, the emitters emit electrons to the pixel regions, to produce a visible light image. The light at each pixel is controlled by the current in the emitters facing the respective pixel.

The cathode and anode are assembled very close together, e.g., about 200–250 microns, in a package with a vacuum seal, such as a frit glass seal, at or near the perimeter of the anode and cathode. In the small space between the anode and cathode, any residual gases or molecules can cause arcing or shorting. To address this problem, a getter is placed in the display package and is then activated to sorb free molecules. Placement of the getter is problematic, however, because of the small space. In some FEDs, the cathode is mounted between the anode (also referred to as a faceplate) and a backplate; in this case, a getter can be placed in the space between the cathode and the backplate. While saving space, such placement puts the getter away from the space between the cathode and anode where gettering is needed most. In other cases, the getter is placed on the side of the cathode and anode, but such placement increases the width of the display without increasing the screen size.

SUMMARY OF THE INVENTION

The present invention includes a display with two parallel plates and a getter that is well-positioned between the plates for gettering molecules without adversely affecting the size of the display.

According to one aspect of the present invention, a display has an anode with a substrate and a grille formed on the substrate and made at least in part of a getter material. The grille defines a plurality of pixel regions that are coated with phosphor before the display is assembled and vacuum sealed. After the display is sealed or during sealing, the getter is subjected to energy that activates the getter without causing other portions of the display to exceed their respective breakdown temperatures. The process of applying the getter can be performed with masking and etching techniques. The display is preferably an FED having a cathode that has a plurality of conical emitters for emitting electrons to the pixel regions. The anode assembled and vacuum sealed with the cathode so they are parallel to each other.

According to another aspect of the present invention, a display has a grille on a substrate to define pixel regions to be coated with phosphor, and a getter material formed over at least a portion of the grille but not over the defined regions. The getter can be formed over the entire grille or only over selected rows and/or columns of the grille. The getter can be formed directly on the grille, or over the grille but directly on an intermediate conductive layer.

By making the grille at least in part out of a getter material, a getter is provided at a useful location for gettering, ie., between the anode and the cathode. Because the getter is serving both a getter function and a grille function, the getter does not require additional space or an additional number of components over a display without a getter. The display can therefore omit the need for an additional getter. If the getter material is put over the grille, it provides gettering without adding to the width of the device. Other features and advantages will become apparent from the following detailed description, drawings, and claims.

DETAILED DESCRIPTION

Figure 1:
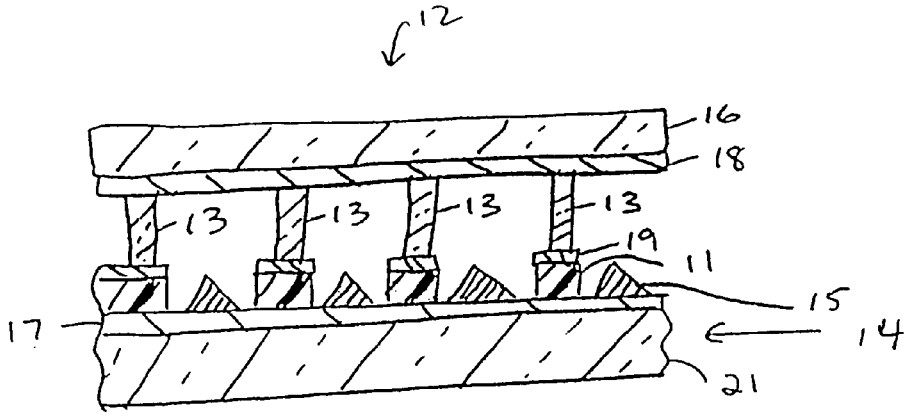
FIG. 1 is a cross-sectional view of a packaged display.

Referring to FIG. 1, a field emission display (FED) 10 has an anode (faceplate) 12 and a cathode 14 oriented in parallel and separated by dielectric spacers 13. Anode 12 has a transparent dielectric layer 16, preferably made of glass, and a transparent conductive layer 18, preferably made of indium tin oxide (ITO), formed on layer 16 and facing cathode 14. In cathode 14, a plurality of generally conical emitters 15 are formed on a series of conductive strips 17 and are surrounded by a dielectric oxide layer 11 and a conductive extraction grid 19 as is generally known. Conductive strips 17 are formed on a substrate 21 that may be glass or single crystal silicon. The cathode can be formed directly on a backplate, or it can be formed between the anode/faceplate and a separate backplate. In either case, the anode and cathode are disposed close together in a vacuum sealed package.

Figure 2:
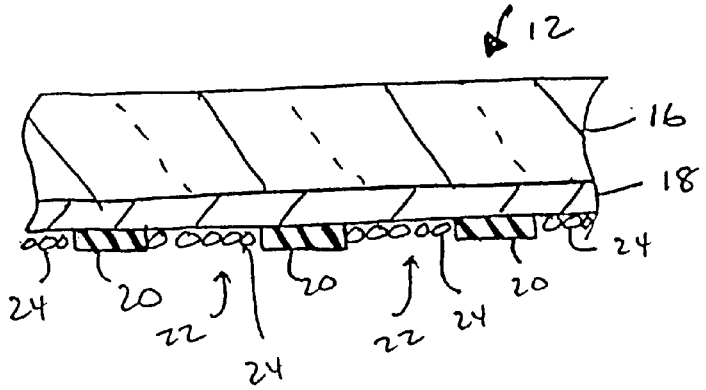
FIG. 2 is a cross-sectional view of an anode in the display of FIG. 1.
Figure 3:
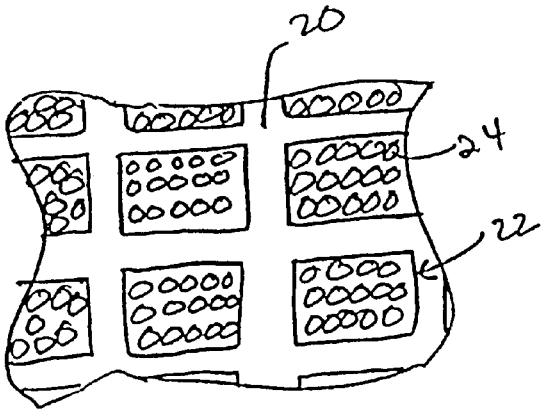
FIG. 3 is a plan view of the anode of FIG. 2.

Referring to FIGS. 2–3, which show anode 12 in more detail, a grille 20 is formed on conductive layer 18 to define a number of pixel regions 22 (a single pixel area on the display screen will typically have multiple pixel regions). Regions 22 are then coated with phosphor particles 24. Such a grille is typically made of a black matrix material, such as cobalt oxide, manganese oxide, diaqueous graphite (DAG), or a combination of a layer of chrome oxide and a layer of chrome. Each pixel region has a large plurality (e.g., 100) of conical emitters 13 (FIG. 1) associated with it.

According to one embodiment of the present invention, grille 20 is made at least in part of a getter material. An exemplary suitable getter is a powder sold under the tradename St 707 by SAES Getters S.p.A of Milan, Italy. This particular getter is nonevaporable and is an alloy of zirconium (Zr), vanadium (V), and iron (Fe). This getter has a surface that sorbs free molecules until it is saturated. It can then be activated (or reactivated) at relatively low temperatures, e.g., 450° C. for 10 minutes, or at lower temperature with heating for a longer period of time. Such activation causes previously sorbed molecules to diffuse into the material, leaving the surface of the getter free to sorb further molecules. These processes of saturation and activation can be repeated many times with such a nonevaporable getter. Other getters and types of getters such as appropriate evaporable getters could also be used. Other known getter material include titanium, barium, aluminum, and calcium.

The substrate of anode 12, particularly glass dielectric layer 16, may include material with a breakdown temperature below the activation temperature of the getter material. As used here, "breakdown temperature" refers to the temperature at which the substrate undergoes an unacceptable change in viscosity or other physical property. The activation energy is provided such that the temperature of the other parts of anode 12 remain below their respective breakdown temperatures. The heat used to hermetically seal the anode and cathode can activate the getter; alternatively, after the package is sealed, heat can be applied to the getter in one of a number of ways, e.g., with rapid thermal processing (RTP), with an RF or a microwave field, with laser energy, or with ultrasonic energy. The getter should be heated to its activation temperature at a rate that is fast enough to cause activation, but slow enough to avoid heating the other components to their breakdown temperatures.

Figure 4:
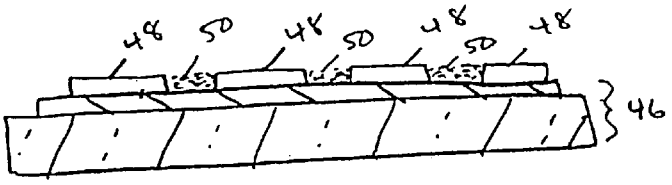
FIGS. 4–5 are cross-sectional views illustrating steps for making the anode of FIG. 2.

Referring to FIG. 4, a method for forming a grille 46-with at least some getter material includes steps of providing a powder 50 through a removable patterned mask 48, such as a photoresist mask, and removing mask 48 to leave pixel regions where mask 48 previously covered substrate 46. Powder 50 is sintered to substrate 46 with a sintering energy (that may also activate the getter prior to sealing). The sintered powder thus forms the grille or a part thereof. The regions defined by the grille are then coated with phosphor, the anode and cathode are sealed together, and if needed, the getter is then activated.

Figure 5:
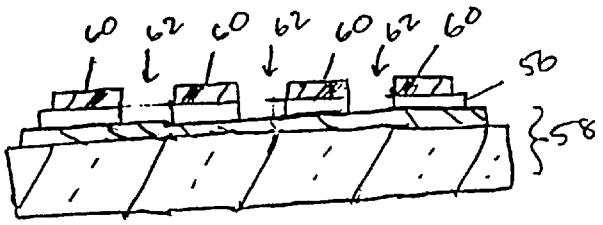

Referring to FIG. 5, another method for forming a grille includes providing the getter material as a continuous layer 56 over a substrate 58, forming a photomask 60 over the getter layer 56, and forming holes 62 in layer 56 by etching. After etching, photomask 60 is removed. Phosphor is then deposited in holes 62 and the device is assembled by known processes. The getter can then be activated if riot already activated by the heat during assembly.

Figure 6:
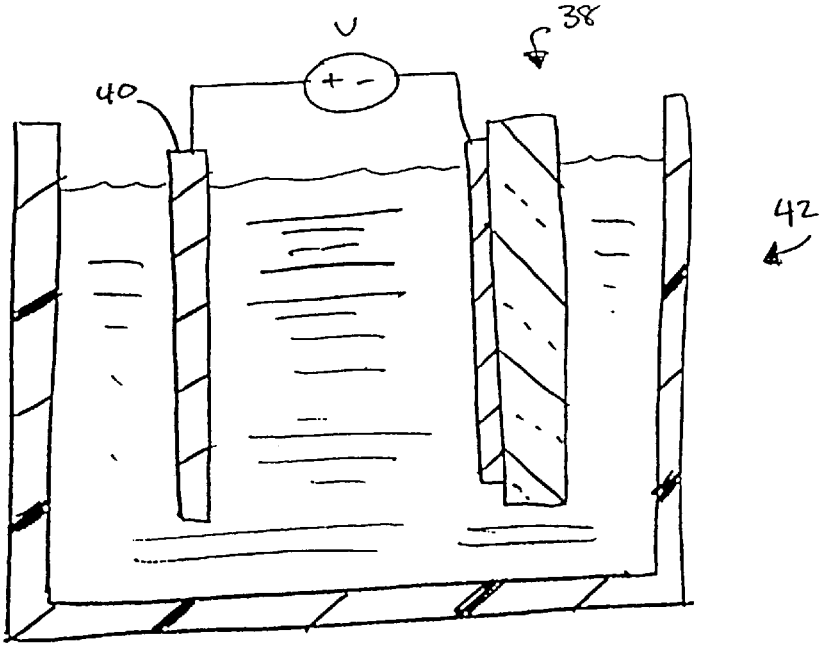
FIG. 6 is a cross-sectional view of a device for forming a layer of getter material.

Referring to FIG. 6, one method for applying a getter material to a substrate 38 (shown here with a glass layer and a conductive layer) in a continuous layer includes applying a voltage V between substrate 38 and an electrode 40, with electrode 40 and substrate 38 in an electrophoretic bath 42. The getter material can then be partially removed as discussed, for example, in connection with FIG. 6.

Figure 7:
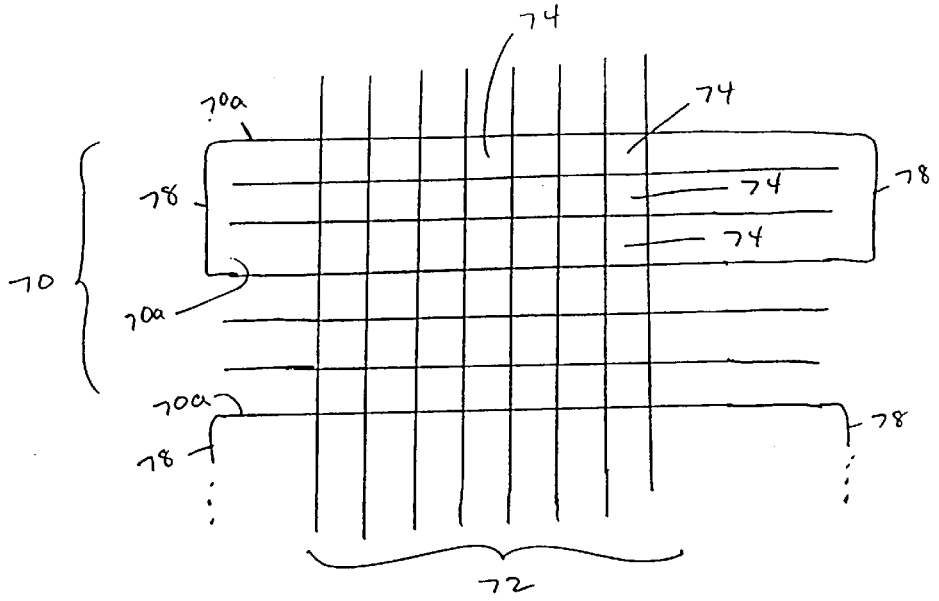
FIG. 7 is a schematic plan view illustrating rows and columns of a grille.

Referring to FIG. 7, lines 70 and 72 respectively represent rows and columns of a grille that defines phosphor-coated regions 74. While the getter material can be used to form the entire grille, it can also be used to form a part of the grille. Accordingly, in one embodiment of the present invention, the entire grille, i.e., all of rows 70 and column 72, consist primarily of the getter material. In another embodiment, part of the grille is made from a nongettering material, such as black matrix material, while selected rows and/or columns or portions thereof are made from the getter material. In such a case, the getter material could be used for every second, third, or generally n-th row or column. It is not necessary, however, for there to be a regular pattern; the getter can be formed in an arbitrary form. As shown in FIG. 7, every third row 70*a* is made of getter, while the other rows and all the columns are made from black matrix. If RF inductive heating is to be used, the ends of adjacent rows or columns made of getter material can be electrically coupled together, e.g., with getter connection pieces 78, su that the getter material forms a number of extended rectangular rings.

Figure 8:
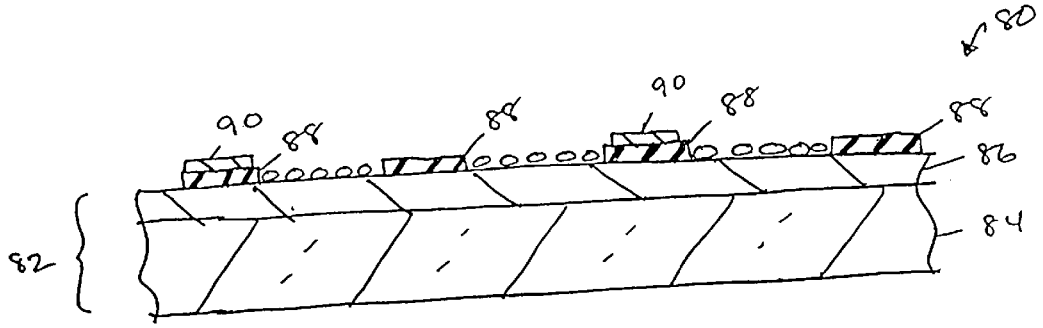
FIGS. 8–9 are cross-sectional views of an anode according to further embodiments of the present invention.

Referring to FIG. 8, in another embodiment, an anode 80 has a substrate 82 with glass layer 84 and conductive layer 86. A black matrix grille 88 is patterned on substrate 82, and then a layer 90 of getter material is formed over at least part of grille 88, e.g., through a mask. In this case, the getter material can be patterned over all of the rows and all of the columns that make up grille 88, or it can be patterned over selective n-th rows and/or columns, and if desired connected at the ends to form closed loops, or even formed in a more arbitrary and non-regular manner. As shown here, every second row or column has a getter layer.

Figure 9:
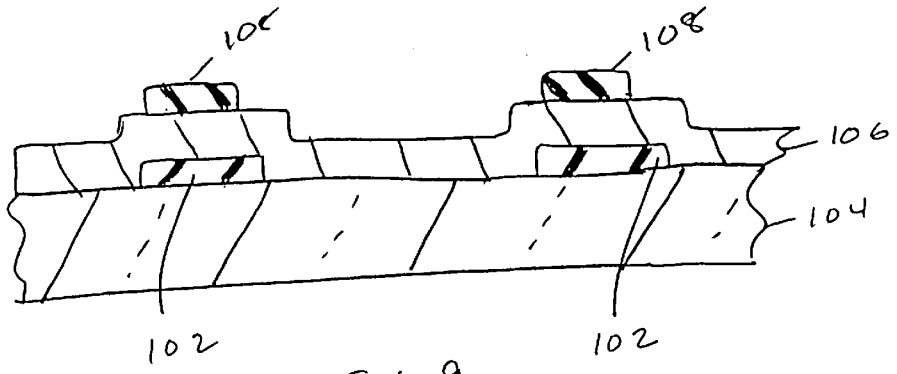

The amount of getter material that is used, i.e., the number of rows, columns, or parts of the grille that are formed of getter material or that have getter material formed thereon, will depend on the extent to which such gettering is needed during the lifetime of the operation of the display. If substantial gettering is required, all of the grille can be made of, or covered with, getter material. If less gettering is needed, only small parts can be made of, or covered with, getter material Referring to FIG. 9, in yet another embodiment of the present invention, an anode/faceplate 100 has a grille 102 formed over a transparent dielectric layer 104, preferably made of glass. A conductive layer 106, preferably indium tin oxide (ITO), is then formed over grille 102 and layer 104. A getter material 108 is formed over conductive layer 106, preferably at locations where grille 102 is formed. This location is desirable so that the getter material does not block electrons that would otherwise not be blocked by grille 102 anyway. As shown in FIG. 9, getter material 108 is formed over grille 102 with an intermediate conductive layer 106 and is shown formed with lesser width and over each portion of the grille. The width, the number of rows or columns of the grille over which the getter is formed, and the pattern of getter material can be varied as discussed above.

Having described embodiments to the present invention, it should be apparent that modifications can be made without departing from the scope of the invention as defined by the appended claims. While the grille made at least in part of getter material preferably replaces all other getters and hence preferably constitutes substantially all of the getter material in the sealed package, other getters could be provided in the package as needed.

What is claimed is:

1. A display device comprising:

an anode including:

a substrate, a grille formed on the substrate, the grille defining a plurality of pixel regions on the substrate, a conductive layer formed over portions of the grille, a getter layer formed over the conductive layer at locations over the grille.

2. The device of claim 1, wherein the getter material is formed from a powder.

3. The device of claim 2, wherein the powder includes an alloy of zirconium, vanadium, and iron.

4. The device of claim 1, wherein the getter material includes a material selected from the group consisting of barium, titanium, and zirconium.

5. The device of claim 1, further comprising a cathode with a plurality of conical electron emitters associated with each of the pixel regions, the anode and cathode assembled together in a vacuum sealed package so that electrons emitted from the emitters strike the phosphor coated regions.

6. The device of claim 1, further comprising a cathode, the anode and cathode assembled together in a vacuum package.

7. The device of claim 1, further comprising a phosphor coating on the defined pixel regions.

8. The device of claim 1, wherein the grille includes one of cobalt oxide, manganese oxide, diaqueous graphite, and chrome oxide.

9. A display device comprising:

an anode including:

a substrate, a grille formed on the substrate and defining pixel regions thereon and formed entirely of a getter material, and a phosphor coating on the defined pixel regions.

10. The device of claim 9, wherein the getter material is formed from a power.

11. The device of claim 10, wherein the powder includes an alloy of zirconium, vanadium, and iron.

12. The device of claim 9, wherein the getter material includes a material selected from the group consisting of barium, titanium, and zirconium.

13. The device of claim 9, further comprising a cathode with a plurality of conical electron emitters associated with each of the pixel regions, the anode and cathode assembled together in a vacuum sealed package so that electrons emitted from the emitters strike the phosphor coated regions.

14. The device of claim 9, further comprising a cathode, the anode and cathode assembled together in a vacuum package.

15. The device of claim 9, wherein the grille includes one of cobalt oxide, manganese oxide, diaqueous graphite, and chrome oxide.

* * * * *